US012753514B2

(12) United States Patent
An et al.

(10) Patent No.: US 12,753,514 B2
(45) Date of Patent: Oct. 6, 2026

(54) METHOD FOR FORMING ELECTROLESS PLATING ELECTRODE THROUGH SELECTIVE CROSS-LINKING LAYER FORMATION USING LASER

(71) Applicant: Andong National University Industry-Academic Cooperation Foundation, Andong-si (KR)

(72) Inventors: Tae Chang An, Gyeongsangbuk-do (KR); Do Yeon Im, Andong-si (KR); Jin Hwan Park, Andong-si (KR)

(73) Assignee: Andong National University Industry-Academic Cooperation Foundation, Andong-si (KR)

( * ) Notice: Subject to any disclaimer, the term of this patent is extended or adjusted under 35 U.S.C. 154(b) by 34 days.

(21) Appl. No.: 18/969,718

(22) Filed: Dec. 5, 2024

(65) Prior Publication Data

US 2025/0230549 A1 Jul. 17, 2025

(30) Foreign Application Priority Data

Jan. 15, 2024 (KR) ..... 10-2024-0006107

(51) Int. Cl.
*C23C 18/16* (2006.01)

(52) U.S. Cl.
CPC ..... *C23C 18/1612* (2013.01); *C23C 18/1641* (2013.01); *C23C 18/1666* (2013.01); *C23C 18/1676* (2013.01)

(58) Field of Classification Search
CPC ..... C23C 18/1312
See application file for complete search history.

(56) References Cited

U.S. PATENT DOCUMENTS 3,900,320 A * 8/1975 Rolker ..... G03F 7/0047 430/315
2005/0233593 A1* 10/2005 Brunet ..... H05K 1/0219
2015/0239217 A1* 8/2015 Watanabe ..... B81C 3/001 156/278

FOREIGN PATENT DOCUMENTS

JP 2008224916 * 9/2008

OTHER PUBLICATIONS

Machine translation of document N.*

* cited by examiner

*Primary Examiner* — Austin Murata
(74) *Attorney, Agent, or Firm* — You & IP, LLC

(57) ABSTRACT

Proposed is a method for forming an electroless plating electrode through selective cross-linking layer formation using a laser, specifically, the method includes forming a selective cross-linking layer by sintering a water-soluble polymer thin film layer, which is formed on a substrate by coating, to form a patterned shape thereon using a laser, followed by forming a precise metal pattern by electroless-plating the selective cross-linking layer with copper, nickel, or other metals. The method offers a simple manufacturing process, cost efficiency, and flexibility in manufacturing without being limited by the shape of a substrate, thereby patterns may be formed on various substrates. A catalyst material for electroless plating is mixed with a polymer material to directly cross-link the substrate. Thus, durability is improved but also an electrode may be formed with a substrate by electroless plating simply and in a short time due to use of only a single material.

9 Claims, 13 Drawing Sheets

METHOD FOR FORMING ELECTROLESS PLATING ELECTRODE THROUGH SELECTIVE CROSS-LINKING LAYER FORMATION USING LASER

STATEMENT REGARDING GOVERNMENT SPONSORED RESEARCH

This invention was supported by the National Research Foundation of Korea funded by the Ministry of Education of Korea. [Research Project name: "Regional Innovation Strategy (RIS) based on local government-university cooperation"; Research Subject name: "Daegu Gyeongbuk Regional Innovation Platform) Kyungpook National University; Project Serial Number: 1345370813; Research Subject Number: 2022RIS-006].

This invention was supported by the Regional Innovation System & Education (RISE) program through the Gyeongbuk RISE Center, funded by the Ministry of Education (MOE) and the Gyeongsangbuk-do, Republic of Korea (Research Subject Number: 2025-RISE-15-104).

CROSS REFERENCE TO RELATED APPLICATION

The present application claims priority to Korean Patent Application No. 10-2024-0006107, filed Jan. 15, 2024, the entire contents of which is incorporated herein for all purposes by this reference.

BACKGROUND OF THE DISCLOSURE

1. Field of the Disclosure

The present disclosure relates to a method for forming an electroless plating electrode through selective cross-linking layer formation using a laser. More specifically, the present disclosure relates to a method for forming an electroless plating electrode through selective cross-linking layer formation using a laser, the method including forming a selective cross-linking layer by sintering a water-soluble polymer thin film layer, which is formed on a substrate by coating, to form a patterned shape thereon using a laser, followed by forming a precise metal pattern by electroless-plating the selective cross-linking layer with copper, nickel, or other metals.

2. Description of the Related Art

Electroless plating is, in contrast to electrolytic plating, a plating method through a chemical reaction with no use of electricity. In electrolytic plating, metal reduction is possible only using an external power source, meanwhile, in electroless plating, a method of adding a reducing agent to a plating solution without electricity is adopted, so positive ions react with the reducing agent to precipitate metal ions. Due to that, in electroless plating, plating is possible even on non-conductors, which means possibility of plating on glass or PVB substrates. Therefore, electroless plating has been utilized in various industries. Representative examples of electroless plating include electroless copper plating and electroless nickel plating, which are used for plastic plating.

A process of electroless plating plays an important role as one of the element techniques which are used to form various gadgets and devices used in the recently advanced information society. However, the current demand for implementing functionalization or low-cost devices is expected to increase the importance of electroless plating in the future.

In addition, due to the demand for advanced electronic gadget performance and highly integrated circuits, fine pattern formation for semiconductor devices is required. Currently, in these areas, electroless plating is applied. Given that, more advanced pattern precision control techniques will be needed in the future.

In addition, conventional methods used to form patterns on substrates have mainly multi-step processes such as photolithography and vacuum deposition, and also the conventional methods require expensive equipment using chemicals undesirable to the environment. Photolithography is currently the most widely used process in the production of electronic devices and a method of forming circuits on a substrate by using light and photographic techniques. In general, the order of the photolithography process is to apply photoresist on a semiconductor wafer using a method such as spin coating, followed by positioning a photomask and partially exposing the photoresist to light through a light application. Afterward, the portion of the photoresist that has undergone chemical changes due to light exposure is removed with a special solution called a developer, and then the remaining part goes through etching and photoresist removal processes. Herein, etching is a process of removing portions not protected by photoresists using liquid or plasma. After etching, the photoresist is removed from the substrate because the photoresist is no longer needed.

The current photoresist process requires expensive equipment or devices such as vacuum equipment and photomasks. In addition, substantial expenses are incurred since most materials are discarded during the process. Therefore, it is necessary to develop a new process to solve the problems of the process.

SUMMARY OF THE DISCLOSURE

According to the method for forming an electroless plating electrode through selective cross-linking layer formation using a laser, one objective of the present disclosure offers a simple manufacturing process, cost efficiency, and flexibility in manufacturing without being limited by the shape of a substrate.

Additionally, another objective of the present disclosure is to manufacture an electroless plating electrode through selective cross-linking layer formation using a laser, where the manufacturing process not only enables pattern formation with improved durability but also allows for electroless plating simply and in a short time due to use of only a single material.

A method for forming an electroless plating electrode through selective cross-linking layer formation using a laser according to an embodiment of the present disclosure includes: a polymer solution preparation step of preparing a polymer solution containing a water-soluble polymer with a PVP chain structure, a polymer thin film layer formation step of forming a water-soluble polymer thin film layer made of the polymer solution on a surface of a substrate through coating the substrate with a polymer solution, a selective cross-linking layer formation step of forming a selective cross-linking layer by sintering the polymer thin film layer through laser irradiation, a residue removal step of removing a portion other than the portion for the selective cross-linking layer formed through laser irradiation, a catalyst activation step of activating a catalyst by performing a plasma treatment process on the substrate, and an electroless plating step of forming an electroless plating layer on the upper part of the selective cross-linking layer by performing an electroless plating process on the selective cross-linking layer, which is formed on the substrate.

Additionally, in the polymer solution preparation step, a polymer-Pd composite material may be prepared by mixing a water-soluble polymer material with ethanol and a palladium compound.

The palladium compound may include one or more selected from the group consisting of palladium chloride ($PdCl_2$), tetraaminepalladium dinitrate ($Pd(NH_3)_4(NO_3)_2$), tetraamine palladium dichloride ($Pd(NH_3)_4Cl_2$), diamine palladium dichloride ($Pd(NH_3)_2Cl_2$), and palladium acid ($Pd(NO_3)_2 \cdot XH_2O$) or include a water-soluble palladium compound.

The water-soluble polymer material may include one or more selected from the group consisting of polyvinyl alcohol (PVA), polyvinyl pyrrolidone (PVP), and polyacrylic acid (PAA) or include derivatives thereof.

In the polymer thin film formation step, a uniform thin film may be formed on a substrate with the water-soluble polymer material by any one method selected from the group consisting of spin coating, dip coating, and spray coating.

The substrate may include glass or a polymer material and may be a transparent material.

In the selective cross-linking layer formation step, a selective cross-linking layer may be formed by causing the polymer chains constituting the polymer thin film layer, which is formed through laser irradiation in the polymer thin film layer formation step, to break into shorter chains, and then bringing the shorter polymer chains cure and adhere to the substrate.

In the selective cross-linking layer formation step, a selective cross-linking layer may be formed by irradiating the substrate with a blue laser according to a patterned shape and adjusting focus of the laser relative to the substrate and transfer speed of the laser, and as a result, sintering the polymer thin film layer and eventually forming a PVP-Pd cross-linking layer.

The laser may be any one selected from the group consisting of a solid laser, a gas laser, and an optical fiber laser.

In the residue removal step, the substrate may be immersed in distilled water or ethanol for 1 to 2 minutes.

In the residue removal step, ultrasonic cleaning may be performed by immersing the substrate in distilled water or ethanol.

The catalyst activation step is a process of activating a catalyst for electroless plating. The process may be performed for 3 minutes using argon gas under conditions of 20 sccm, 100 W, and 100 kHz.

In the electroless plating step, an electroless plating layer may be formed by electroless plating the upper part of the selective cross-linking layer, which is formed on the substrate, with one or more selected from the group consisting of copper (Cu) and nickel (Ni).

The method for forming an electroless plating electrode through selective cross-linking layer formation using a laser according to the present disclosure offers a simple manufacturing process, cost efficiency, and flexibility in manufacturing without being limited by the shape of a substrate, thereby patterns can be formed on various substrates.

In addition, by the method, the catalyst material for electroless plating is mixed with a polymer material to directly cross-link the substrate, which improves durability. Furthermore, it is also possible to form an electrode on a substrate through electroless plating simply and in a short time due to use of only a single material.

DESCRIPTION OF THE PREFERRED EMBODIMENTS

Hereinafter, embodiments of the present disclosure will be described with reference to specific embodiments and the attached drawings. However, the embodiments of the present disclosure may be modified into various other forms, and the scope of the present disclosure is not limited to the embodiments described below. The embodiments of the present disclosure are provided to more completely explain the present disclosure to those skilled in the art.

Throughout the specification, when a certain part is described as being "connected", "joined", "contacted", or "coupled" with another part, this includes not only cases where they are "directly connected" but also cases where they are "indirectly connected" with another member interposed therebetween. Additionally, when a part is said to "include" a certain component, this does not mean that other components are excluded, but that other components can be added, unless specifically stated to the contrary.

The terms used herein are only used to describe specific embodiments and are not intended to limit the invention. Singular expressions include plural expressions unless the context clearly dictates otherwise. In this specification, terms such as "include" or "have" are used to specify the presence of features, numbers, steps, actions, components, parts, or combinations thereof as described in the specification, and should not be interpreted as excluding the possibility of the presence or addition of one or more other features, numbers, steps, actions, components, parts, or combinations thereof.

A method for forming an electroless plating electrode through selective cross-linking layer formation using a laser according to an embodiment of the present disclosure will be described.

Figure 1:
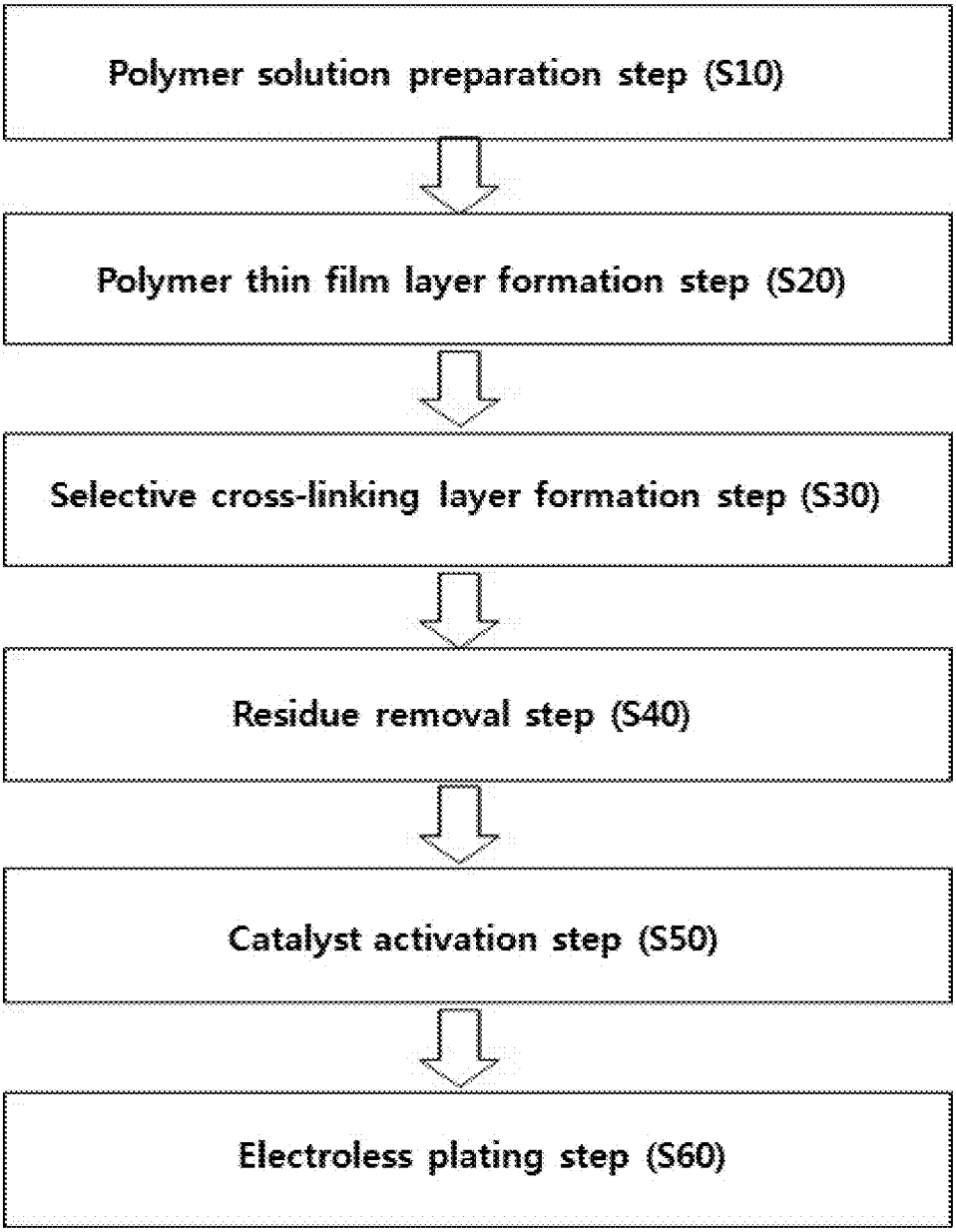
FIG. 1 shows a flowchart of a method for forming an electroless plating electrode through selective cross-linking layer formation using a laser according to an embodiment of the present disclosure.

FIG. 1 shows a flowchart of a method for forming an electroless plating electrode through selective cross-linking layer formation using a laser according to an embodiment of the present disclosure. In addition, FIG. 2 shows a schematic diagram of a method for forming an electroless plating electrode through selective cross-linking layer formation using a laser according to another embodiment of the present disclosure.

Figure 2:
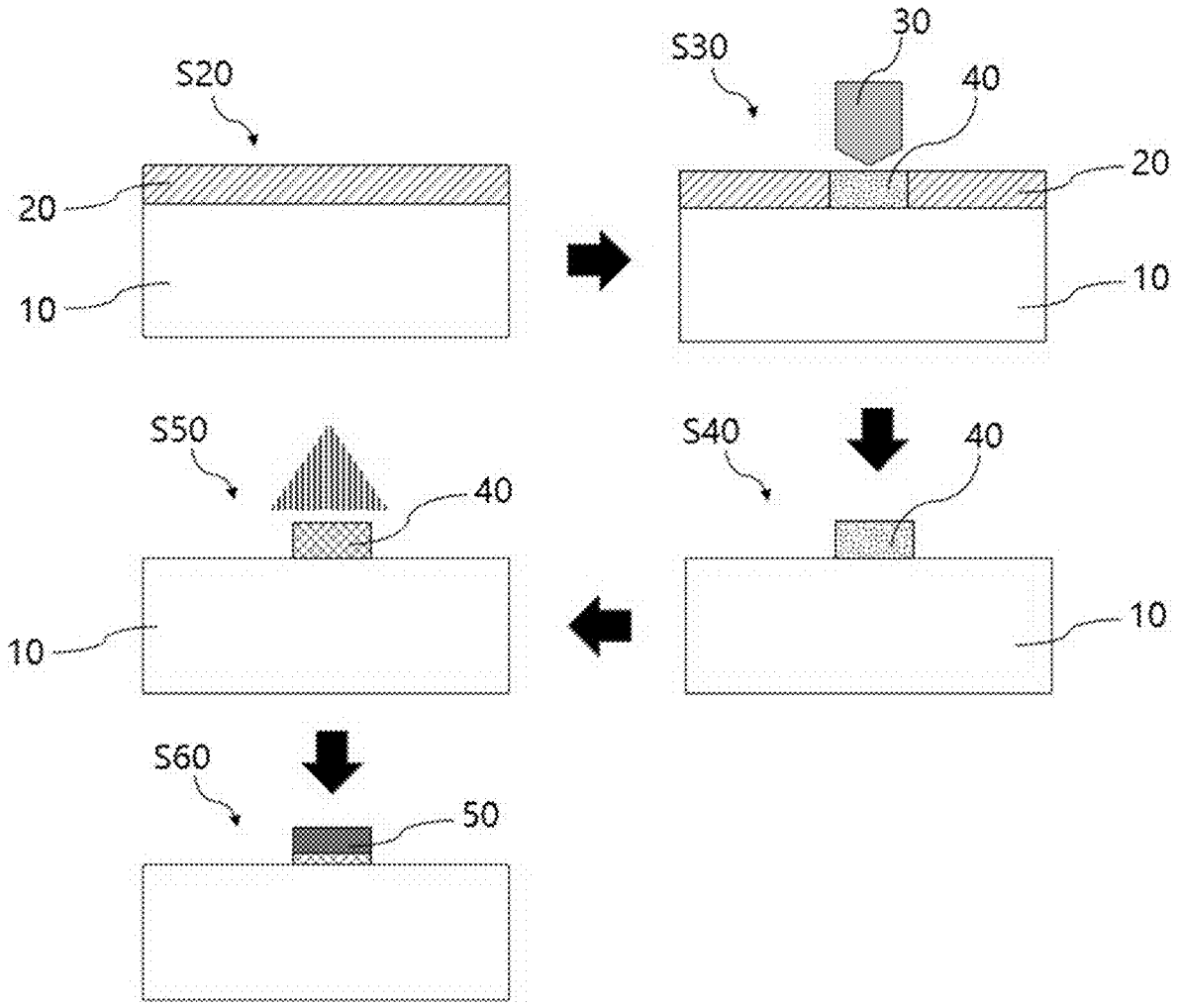
FIG. 2 shows a schematic diagram of a method for forming an electroless plating electrode through selective cross-linking layer formation using a laser according to another embodiment of the present disclosure.

Referring to FIGS. 1 and 2, for forming an electroless plating electrode through formation of a selective cross-linking layer 40 using a laser, the method includes: a polymer solution preparation step S10 of preparing a polymer solution containing a water-soluble polymer with a PVP chain structure, a polymer thin film layer formation step S20 of forming a water-soluble polymer thin film layer made of the polymer solution on a surface of a substrate through coating the substrate with a polymer solution, a selective cross-linking layer formation step S30 of forming a selective cross-linking layer by sintering the polymer thin film layer through laser irradiation, a residue removal step S40 of removing a portion other than a portion for the selective cross-linking layer formed through laser irradiation, a catalyst activation step S50 of activating a catalyst by performing a plasma treatment process on the substrate, and an electroless plating step S60 of forming an electroless plating layer on the upper part of the selective cross-linking layer by performing an electroless plating process on the selective cross-linking layer formed on the substrate.

Specifically, when explaining the method for forming an electroless plating electrode through selective cross-linking layer formation using a laser of the present disclosure, first, a polymer solution containing a water-soluble polymer with a PVP chain structure is prepared (S10).

According to another embodiment of the present disclosure, a polymer-Pd composite material may be prepared by mixing a water-soluble polymer material with ethanol and a palladium compound.

At this point, it is possible to use a material including the palladium compound, which includes one or more selected from the group consisting of palladium chloride ($PdCl_2$), tetraaminepalladium dinitrate ($Pd(NH_3)_4(NO_3)_2$), tetraamine palladium dichloride ($Pd(NH_3)_4Cl_2$), diamine palladium dichloride ($Pd(NH_3)_2Cl_2$), and palladium acid ($Pd(NO_3)_2 \cdot XH_2O$) or includes a water-soluble palladium compound.

The water-soluble polymer material for use may include one or more selected from the group consisting of polyvinyl alcohol (PVA), polyvinyl pyrrolidone (PVP), and polyacrylic acid (PAA), or include derivatives thereof.

The water-soluble polymer material described above may be mixed with a compound containing palladium (Pd), specifically palladium chloride ($PdCl_2$). By mixing palladium chloride with ethanol and polymers such as PVP, PVA, or PAA using ball milling, a PVP-Pd composite solution may be prepared.

Among various metal catalysts, a palladium catalyst may be preferably used in the copper electroless plating process used herein. This is because palladium has a higher reduction potential than copper, and palladium has superior catalytic properties to other metal catalysts.

Next, the prepared polymer solution is coated (spin-coated) to form a water-soluble polymer thin film layer 20 made of the polymer solution on a surface of a substrate 10 (S20).

The substrate 10 may include glass as an electrically insulating material. Additionally, the substrate 10 may include a flexible or elastic polymer material, and a material with high transparency is preferred for the substrate as the electrically insulating material.

For example, the substrate 10 may include any one selected from the group consisting of glass, epoxy, phenol resin, liquid crystal polymer (LCP), polyimide (PI), polyester (PE), glass epoxy, silicone rubber, polydimethylsiloxane (PDMS), and polyvinylidene difluoride (PVDF), but any substrate 10 with high transparency may be used as the electrically insulating material.

The polymer thin film layer 20 may be formed on the upper part of the substrate 10 by coating. A method for the coating may preferably include any one selected from the group consisting of spin coating, inkjet printing, spray, and dip coating.

Figure 3:
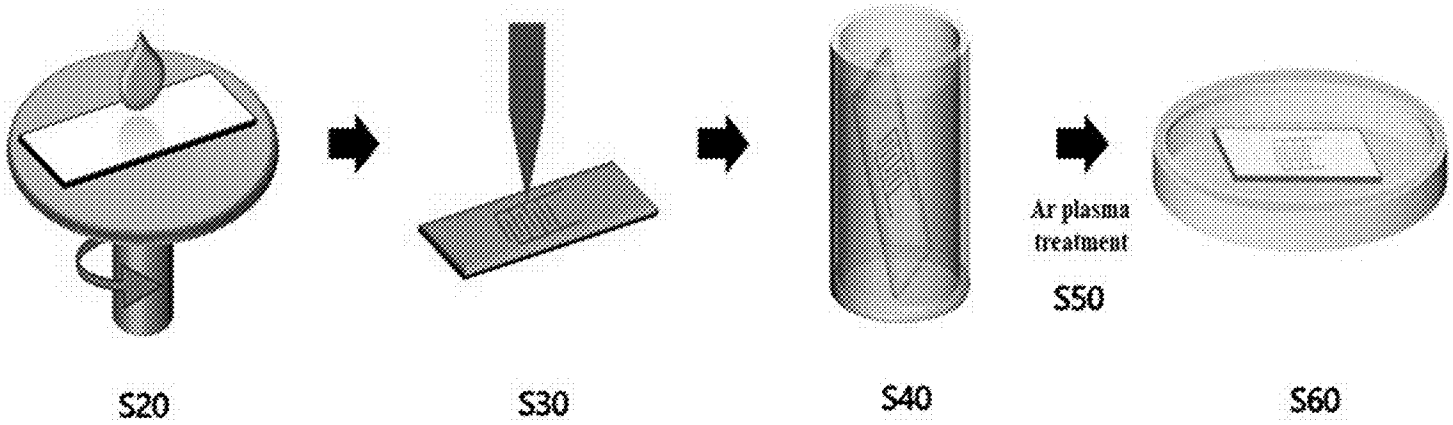
FIG. 3 shows a schematic diagram schematically showing the sequence of the method for forming an electroless plating electrode through selective cross-linking layer formation using a laser according to a further embodiment of the present disclosure.

FIGS. 2 and 3 schematically show the manufacturing sequence of the method for forming an electroless plating electrode through selective cross-linking layer formation according to further embodiments of the present disclosure. Referring to FIGS. 2 and 3, a thin film layer may be formed by spin-coating the upper part of the substrate 10 with the polymer material previously prepared. In addition, it is possible to form a polymer thin film layer 20 by coating the substrate 10 with the prepared polymer material through inkjet printing.

In a yet further embodiment of the present disclosure, a uniform thin film layer was deposited on the glass substrate 10 by spin-coating the substrate 10 with the PVP-Pd composite material at 2000 to 2500 rpm for 10 seconds.

During spin-coating, the rotation speed (rpm) and processing time may be adjusted depending on concentration of the solution. When increasing the rpm, the thickness of the deposited thin film layer becomes thinner, so it is possible to change process conditions such as processing focus of the laser 30 and power.

Preferably, the rotation speed during spin-coating is in a range of 1000 to 3500 rpm. When the rotation speed is less than 1000 rpm, the thickness of the polymer thin film layer 20 may become too thin, and the selective cross-linking layer 40 may not be properly formed by irradiation by the laser 30. When the rotation speed exceeds 3500 rpm, the thickness of the polymer thin film layer 20 becomes excessively thick, making it difficult to form a fine pattern.

When the rotation speed during spin-coating is in a range of 1000 to 3500 rpm, the thickness of the PVP-Pd composite material is moderately thin, and the bonding performance of the PVP-Pd composite material with the substrate 10 is improved through laser processing. Additionally, in an experiment, the electroless plated copper thin film layer was found to have a desirable resistance value at a rotation speed of 1000 to 3500 rpm.

In this way, after the polymer thin film layer 20 is formed on the substrate 10 by coating, the polymer thin film layer 20 is irradiated with the laser 30 to sinter, which is to form the selective cross-linking layer 40 (S30).

Oxygen in the PVP chain structure acts as a binder at the interface between the substrate 10 and the PVP chain structure through ionic bonding between metal nanoparticles and amide groups and also acts as a protective agent to prevent aggregation and precipitation of the metal nanoparticles. When the metal nanoparticles covered with PVP are treated at a high temperature of 80° C. or higher, PVP chains are broken down into short polymer chains and cured and adhered to the substrate 10.

With the use of the PVP-Pd composite material used herein, it is possible to form patterns selectively. This is because only the cross-linked PVP and palladium nanoparticles adhere to the substrate 10 due to the high temperature of the laser 30. In other words, the polymer material, specifically the PVP-Pd composite material adheres to only the laser-treated portion of the substrate 10 with no need for a mask, which is essential in previous patterning processes. The selective cross-linking used herein refers to a process where the polymer material is sintered by the thermal energy of the laser 30 and adheres to the substrate 10 by irradiation with the laser 30, thereby selectively forming a pattern.

This pattern shape is designed in advance using software, such as computer-aided design (CAD), and then the polymer thin film layer 20 is sintered by irradiating a pattern formation portion with the laser 30.

The nanoparticle thin film layer formed on the substrate 10 by coating is patterned using software such as computer-aided design (CAD) and then is selectively sintered using the laser 30. The metal nanoparticles before selectively sintering with the laser 30 are coated with an organic material and do not exhibit conductivity. However, the coating becomes removed by the laser 30, making the metal nanoparticles connected to each other to form a circuit.

In the present disclosure, it is better to use a blue laser as the laser 30.

By carefully controlling the type, wavelength, or intensity of the laser 30, the selective cross-linking layer 40 of the required shape may be formed.

Specifically, the formation of the selective cross-linking layer 40 of the present disclosure is possible on a highly transparent substrate 10 such as glass. It is recommended to use the blue laser with a wavelength of 300 to 600 nm at a power of 10% to 30% (approximately 0.25 to 0.75 W) of the 20 W input power. When the power is less than 10%, thermal cross-linking does not occur. When the power exceeds 30%, the selective cross-linking layer 40 is excessively cured, and the substrate 10 is etched and damaged.

In addition, it is preferable that transfer speed of the laser 30 is in a range of 1 to 5 mm/s, and focus of the laser 30 relative to the substrate 10 is in a range of 1 to 10 mm. When the transfer speed of the laser 30 is less than 1 mm/s, the selective cross-linking layer 40 may be excessively cured, or the substrate 10 may be etched. When the transfer speed of the laser 30 exceeds 5 mm/s, it is impossible to form an even overall selective cross-linking layer 40 due to the transfer speed being faster than the thermal cross-linking reaction time.

In addition, by adjusting the focus, the line width of the selective cross-linking layer 40 made of the PVP-Pd composite material may be adjusted. In the present disclosure, the focus may be in a range of 1 to 10 mm. When the focus is less than 1 mm, the distance between the substrate 10 and the PVP-Pd composite material is too close, which may result in excessive heat treatment. When the focus exceeds 10 mm, heat treatment may not be properly performed because the distance between the substrate 10 and the PVP-Pd composite material is long.

This formation process of the selective cross-linking layer 40 which involves sintering the PVP-Pd composite material through direct irradiation with the laser 30 has a lot of advantages compared to a photolithography process most widely used today. First of all, the selective laser sintering process does not require a vacuum or photomask. Not requiring a vacuum means there is no time to reach the vacuum. This makes higher-speed processing possible than before. The process may also form patterns using CAD. Therefore, the process has the advantage of saving time and cost compared to the photolithography process since the photolithography process requires manufacturing a new photomask when changing a pattern. In addition, as described above, the process may be performed on flexible substrates by reducing thermal damage to flexible substrates (such as plastics) due to a thermodynamic size effect. Good adhesion between a metal pattern and a plastic substrate is also one of the important advantages of the sintering process with a laser.

Next, as shown in FIGS. 2 and 3, the polymer thin film layer 20 other than the pattern-shaped selective cross-linking layer 40, which is formed by irradiation with the laser 30, is removed (S40).

The polymer material present in a portion other than the portion for the selective cross-linking layer 40, which is formed by sintering the polymer material by irradiation with the laser 30, is removed by using an organic solvent.

Specifically, this step is to remove the remaining PVP-Pd composite material in a portion other than the portion where the selective cross-linking layer 40 is formed by irradiation with the laser 30. The step is implemented by immersing the substrate 10 in distilled water or ethanol for 1 to 5 minutes.

In addition to these methods, ultrasonic cleaning equipment may be used for the removal. In an ultrasonic cleaner filled with distilled water or ethanol, the substrate 10 on which the selective cross-linking layer 40 is formed is immersed and ultrasonic cleaned for 1 to 5 minutes, thereby the PVP-Pd composite material remaining in a portion other than the portion for the pattern-shaped selective cross-linking layer 40 is removed.

When the substrate 10 is stored at room temperature for a long time after irradiation with the laser 30, the PVP-Pd composite material on the substrate 10 is cured at room temperature due to ethanol evaporation, and the residue is not completely removed. Therefore, it is best to remove the residue within 1 hour after forming the selective cross-linking layer 40.

In addition, in the method for forming an electroless plating electrode through formation of the selective cross-linking layer 40 using a laser 30 according to a still yet further embodiment of the present disclosure, before forming an electroless plating layer 50, a plasma treatment process to activate a catalyst may be performed (S50).

The plasma treatment process is a process that activates a catalyst for electroless plating. This process makes it possible to remove contaminants from the substrate 10 in a plasma processing device, clean the substrate 10 to a microscopic level, and coat the surface of the substrate to increase surface energy. This is a pretreatment step for electroless plating. After injecting argon or nitrogen gas into the plasma processing device, only the surface of the substrate 10 is heated with plasma to make the surface dense. As a result, this process improves the efficiency of electroless plating performed later and plays a role in preventing peeling after plating.

In a still yet further embodiment of the present disclosure, it is recommended to use argon gas in the plasma processing device for more than 3 minutes under the conditions of a gas flow rate of 20 sccm (Standard Cubic Centimeter per Minute), Rf Power of 100 W, and RF Power Frequency of 100 kHz. When plasma treatment is performed for less than 3 minutes, the catalyst for the substrate 10 is not activated. As a result, electroless plating is not performed smoothly.

Lastly, after the plasma treatment process is completed, a plating process may be performed on the substrate 10 by metal electroless plating to form the electroless plating layer 50 (S60).

A source material used in the electroless plating process may include any one selected from the group consisting of copper (Cu), nickel (Ni), silver (Ag), and alloys thereof.

That is, the material of the electroless plating layer 50 may be different depending on the type of the source material.

Therefore, depending on the electroless plating source material, the electroless plating layer 50 may be formed of any one selected from the group consisting of copper (Cu), nickel (Ni), silver (Ag), and alloys thereof.

By forming the electroless plating layer 50, a metal pattern may be formed in the same pattern as the pattern of the selective cross-linking layer 40, which is formed on the substrate 10.

In the present disclosure, it is preferable to perform electroless copper plating. Specifically, the copper electroless plating solution is prepared by adding 0.04 ml formaldehyde, 14 mg Rochelle salt (potassium sodium tartrate tetrahydrate), 30 mg sodium hydroxide, and 13 mg copper sulfate to deionized water, based on 1 mL of the electroless copper plating solution. In this way, it is recommended to immerse the substrate 10 on which the selective cross-linking layer 40 is formed in the electroless plating solution and to perform electroless copper plating for 1 to 5 minutes. It is best to adjust the electroless plating time depending on the spin-coating process time of the polymer material or the laser 30 irradiation process conditions.

Herein below, the method for forming an electroless plating electrode through selective cross-linking layer formation using a laser according to an example of the present disclosure will be described.

First, a glass bottle containing 500 g of PVP, 10 mL of ethanol, and 5 mL of palladium chloride ($PdCl_2$, concentration: 0.5 mg/mL) is mixed by using a vortex mixer for 2 hours to prepare a PVP-Pd composite material.

A glass substrate was prepared as a substrate 10, and the substrate 10 was spin-coated with a PVP-Pd composite material at 2000 to 2500 rpm for 10 seconds to deposit a uniform thin film layer on the substrate 10.

After coating the substrate 10 with the PVP-Pd composite material, the substrate 10 was irradiated with a laser 30 on the basis of a pre-designed pattern shape using a blue laser with a wavelength of 455 nm and a power of 20% (approximately 0.5 W) of the input power of 20 W. At this point, the transfer speed of the laser 30 was in a range of 1 to 2 mm/s, and the focus of the laser 30 relative to the substrate 10 was in a range of 0 to 5 mm.

After forming a selective cross-linking layer 40, the substrate was immersed in ethanol for 1 to 2 minutes to remove the polymer material, which is the PVP-Pd composite material, present in a portion other than the pattern portion. Then, to activate a catalyst by plasma treatment, argon gas was treated for 3 minutes under conditions of 20 sccm, 100 W, and 100 kHz. Lastly, to prepare a copper electroless plating solution, 0.04 mL of formaldehyde, 14 mg of Rochelle salt, 30 mg of sodium hydroxide, and 13 mg of copper sulfate were added to deionized water, based on 1 mL of copper electroless plating solution. Next, the substrate 10 was immersed in the copper electroless plating solution to perform electroless plating.

Figure 4A:
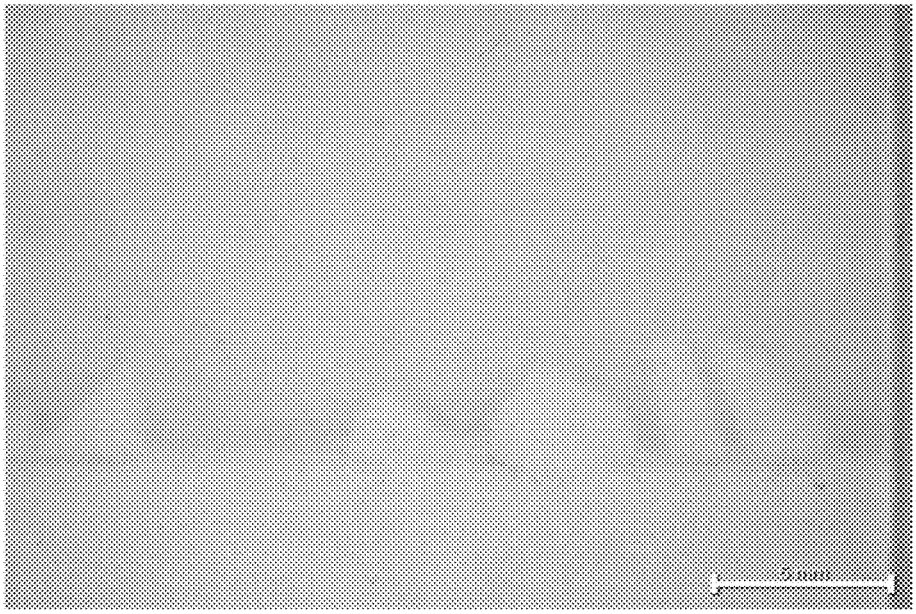
FIGS. 4A to 4F show step-by-step photographs of the process of forming a metal pattern by the method for forming an electroless plating electrode through selective cross-linking layer formation using a laser according to a yet further embodiment of the present disclosure.
Figure 4B:
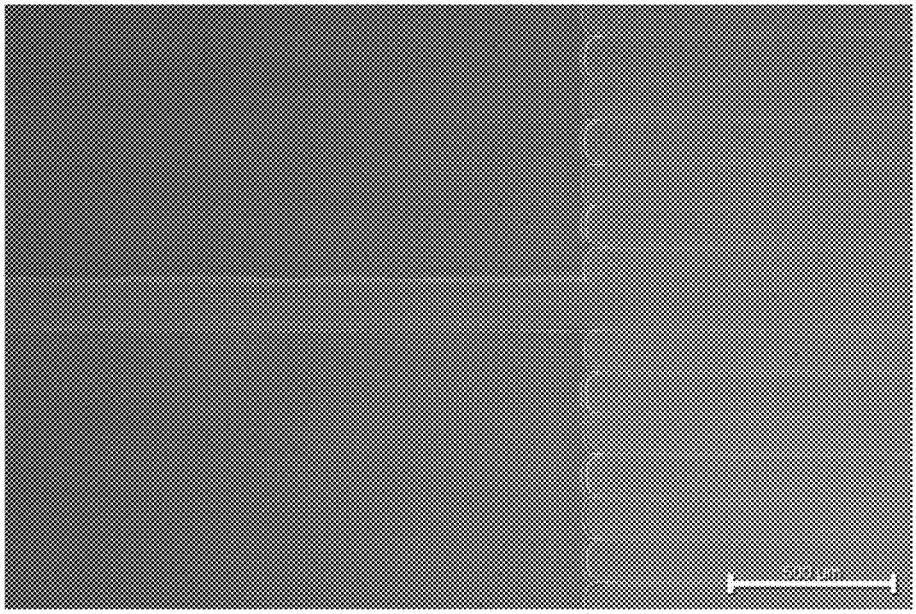
Figure 4C:
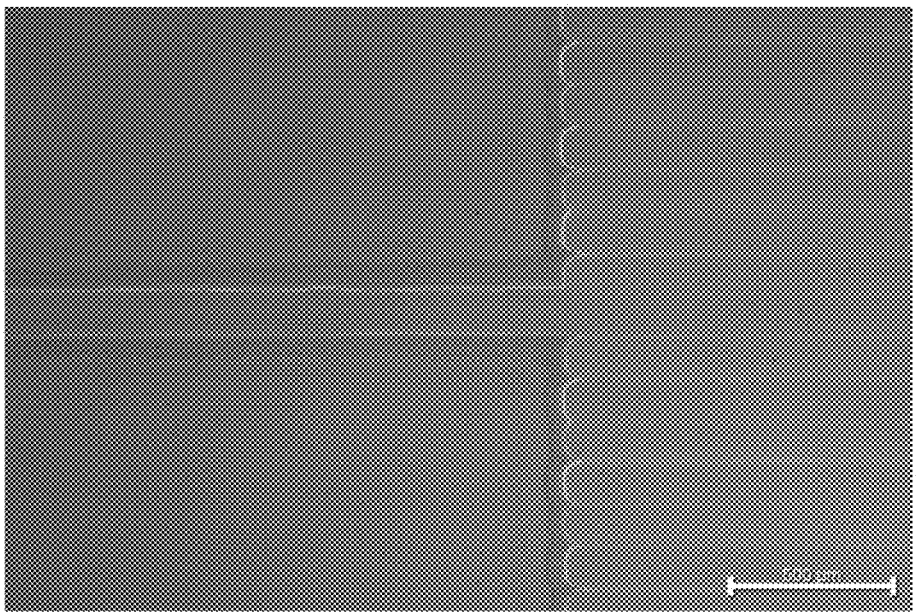
Figure 4D:
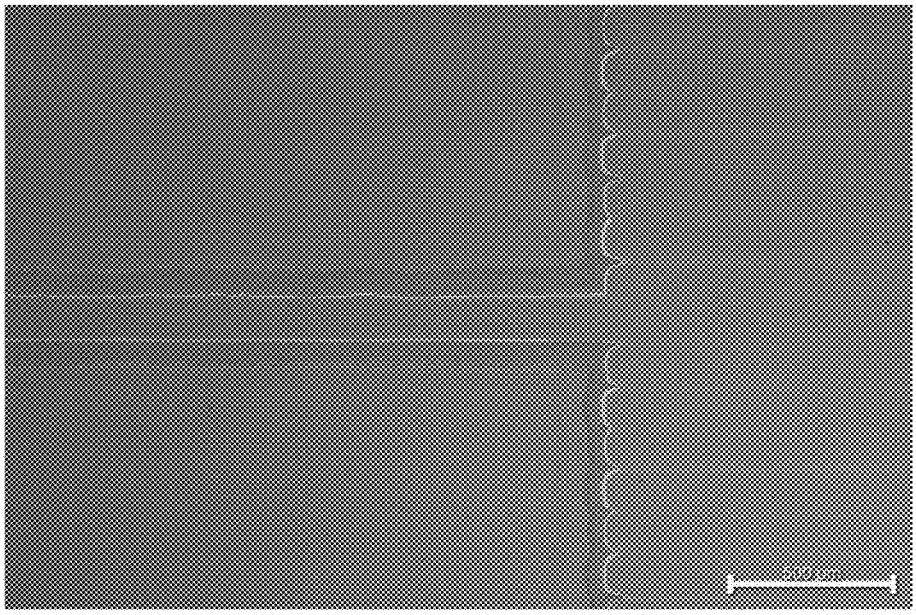
Figure 4E:
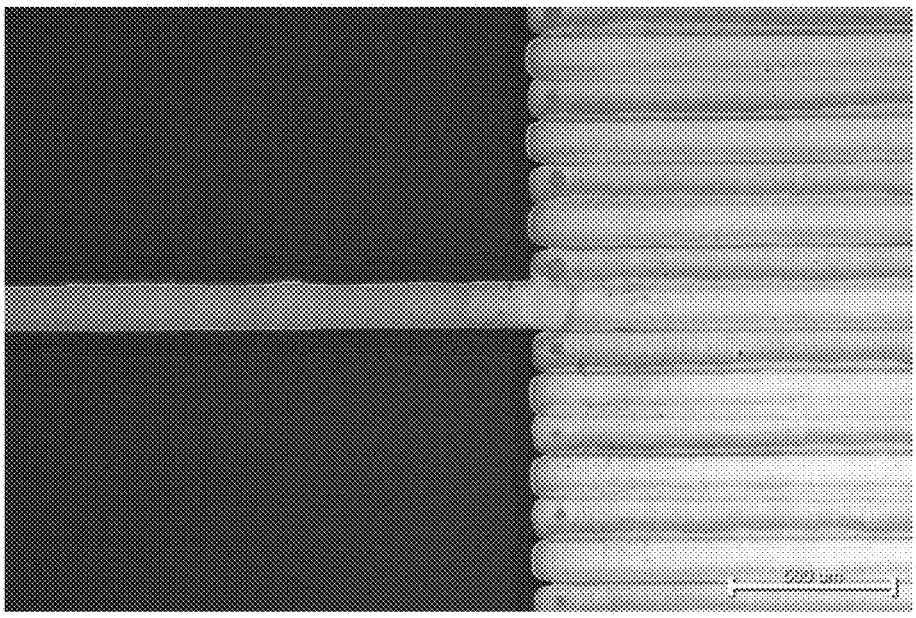
Figure 4F:
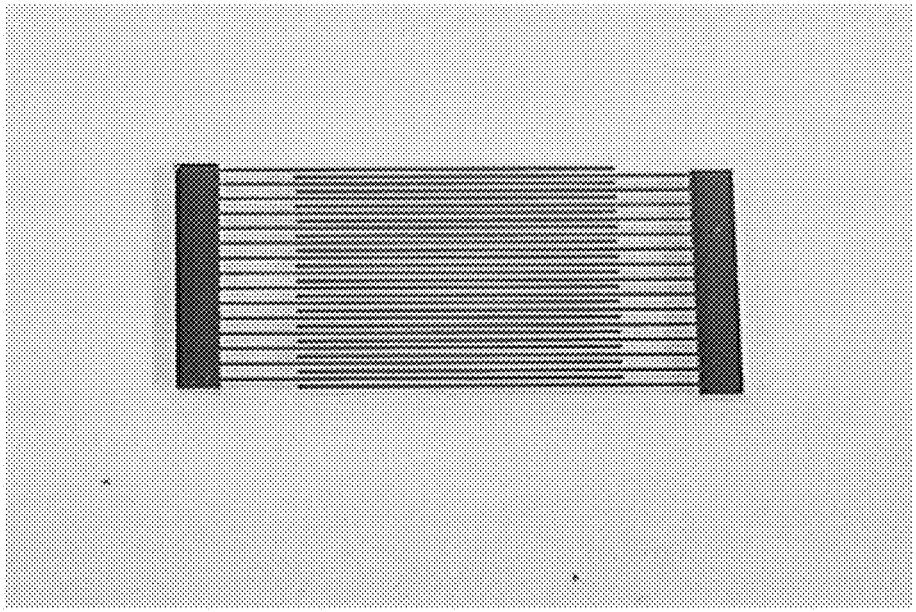
Figure 5A:
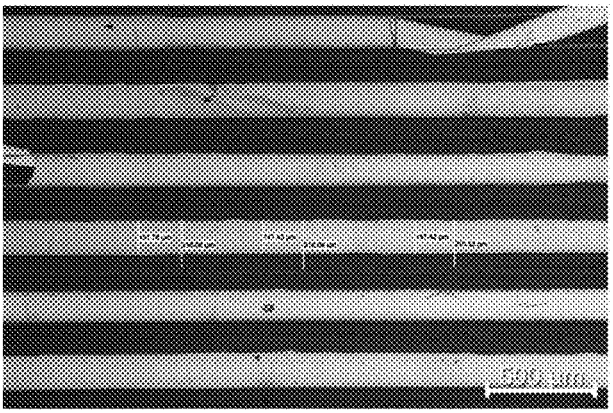
FIGS. 5A to 5F show photographs of PVP-Pd cross-linking pattern linewidth images depending on the laser-substrate focal length.
Figure 5B:
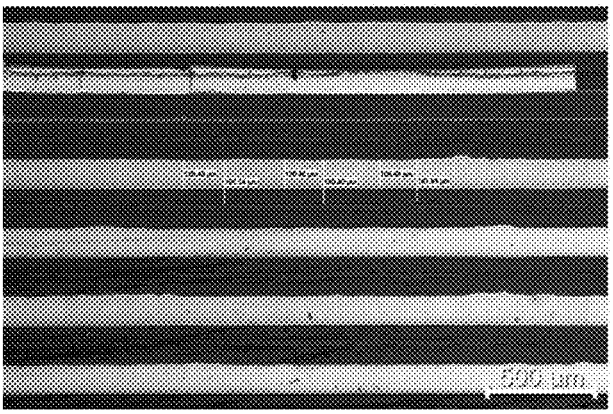
Figure 5C:
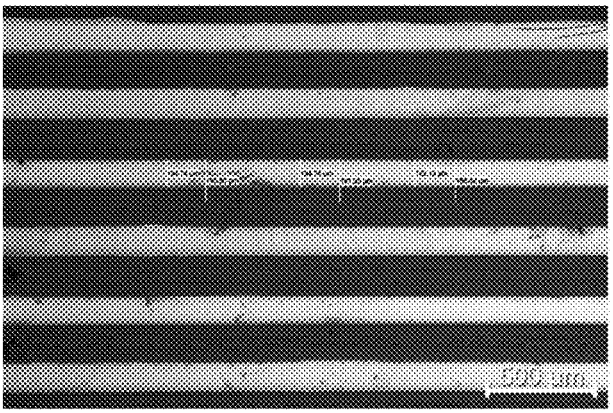
Figure 5D:
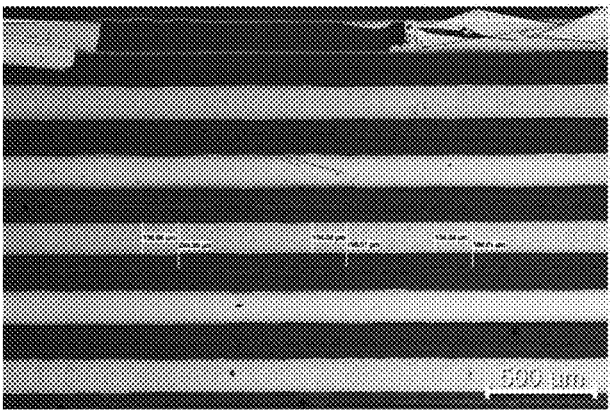
Figure 5E:
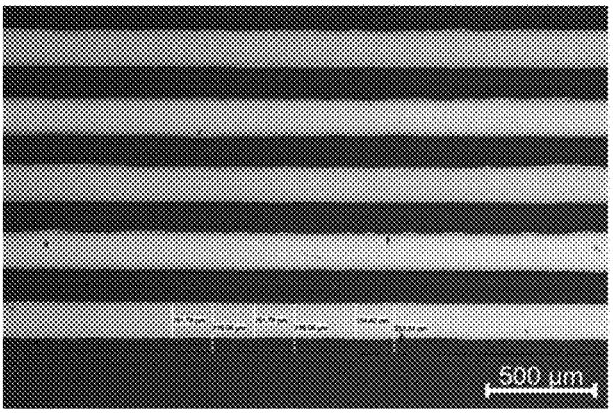
Figure 5F:
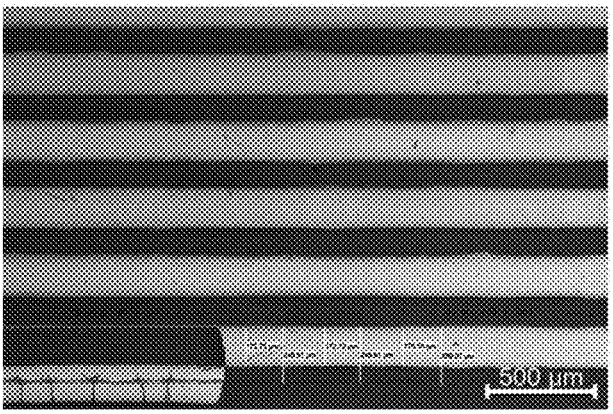

FIGS. 4A to 4F show step-by-step photographs of the process of forming a metal pattern by the method for forming an electroless plating electrode through selective cross-linking layer formation using a laser according to a yet further embodiment of the present disclosure. FIG. 4A shows a photograph of a glass substrate spin-coated with a PVP-Pd composite material. FIG. 4B shows a photograph of a selective cross-linking layer 40 formed by the PVP-Pd composite material by irradiation with a laser 30. In addition, FIG. 4C shows a photograph of a selective cross-linking layer 40 after removing a residue through ethanol washing. FIG. 4D shows a photograph of a selective cross-linking layer 40 after activating a copper electroless plating catalyst through argon plasma treatment. FIGS. 4E and 4F show photographs of a pattern formed by electroless copper plating on the selective crosslinking layer 40.

As shown in FIGS. 4A to 4F, when copper electroless plating was performed after spin-coating a glass substrate with a PVP-Pd composite material, followed by performing sintering with the laser 30 to form a selective cross-linking layer, it was found that a fine pattern was formed on the manufactured substrate 10.

FIGS. 5A to 5F show photographs of PVP-Pd cross-linking pattern linewidth images depending on a laser-substrate focal length. FIGS. 5A to 5F show the formation of a copper pattern formed on the substrate 10, with respective focal lengths of 0 mm for FIG. 5A, 1 mm for FIG. 5B, 2 mm for FIG. 5C, 3 mm for FIG. 5D, 4 mm for FIG. 5E, and 5 mm for FIG. 5F.

Figure 6A:
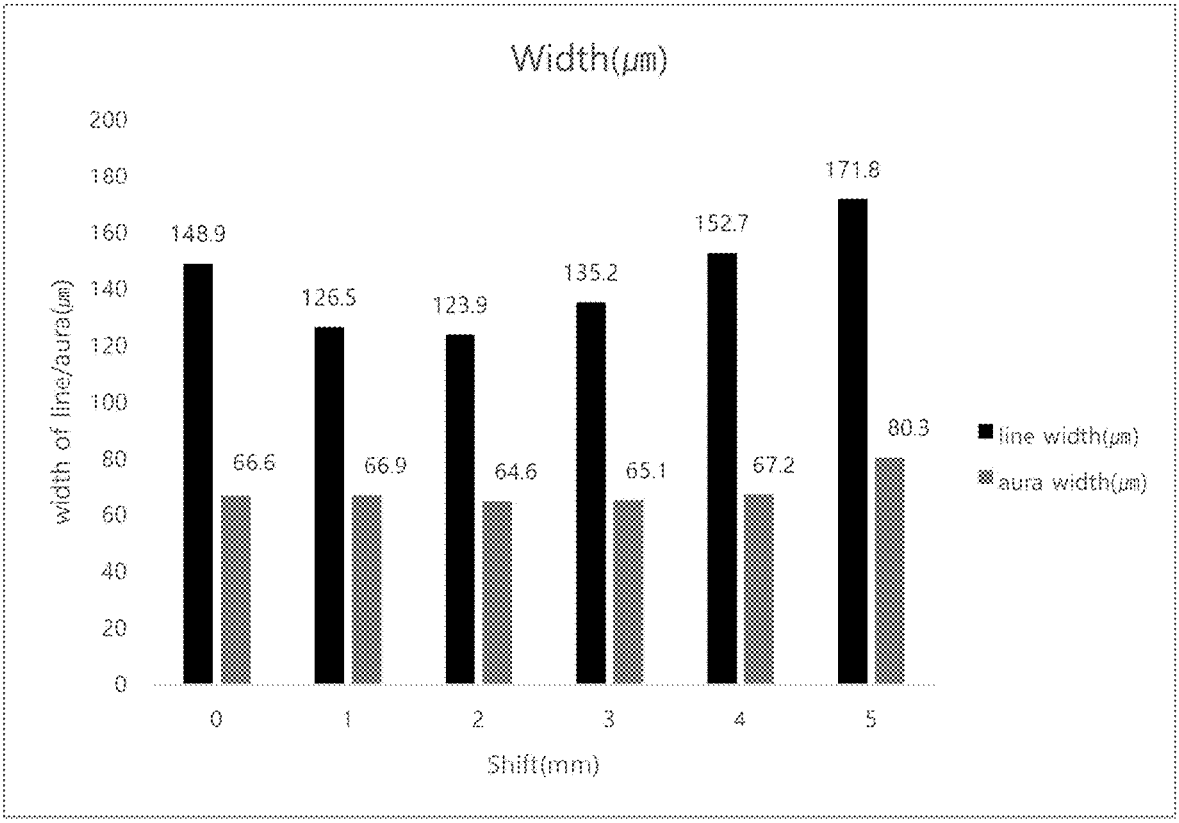
FIGS. 6A and 6B show graphs of PVP-Pd cross-linking pattern lines width depending on the transfer speed of the laser.
Figure 6B:
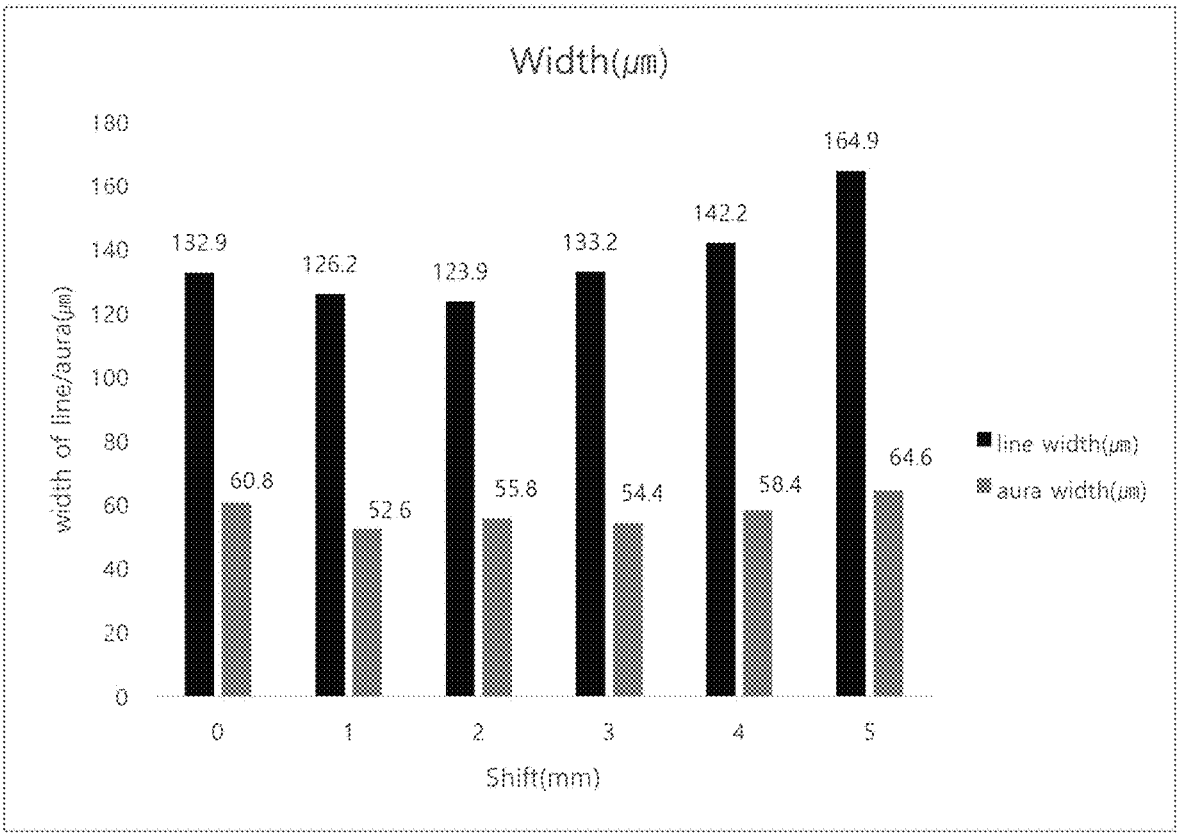

In addition, FIGS. 6A and 6B show graphs of the PVP-Pd cross-linking pattern line width depending on transfer speed of the laser 30. FIG. 6A shows line width measurement results at transfer speed of the laser of 1 mm/s, and FIG. 6B shows line width measurement results at transfer speed of the laser of 2 mm/s.

Considering the results of FIGS. 5A to 6B, when the transfer speed of the laser 30 was 1 mm/s and the distance between the laser focus and the substrate 10 was 2 mm, the minimum line width was about 125 μm. When the electrodes were manufactured as cross-shaped electrodes spaced at 0.3 mm intervals, it was found that each pattern was formed precisely without any overlapping.

Figure 7A:
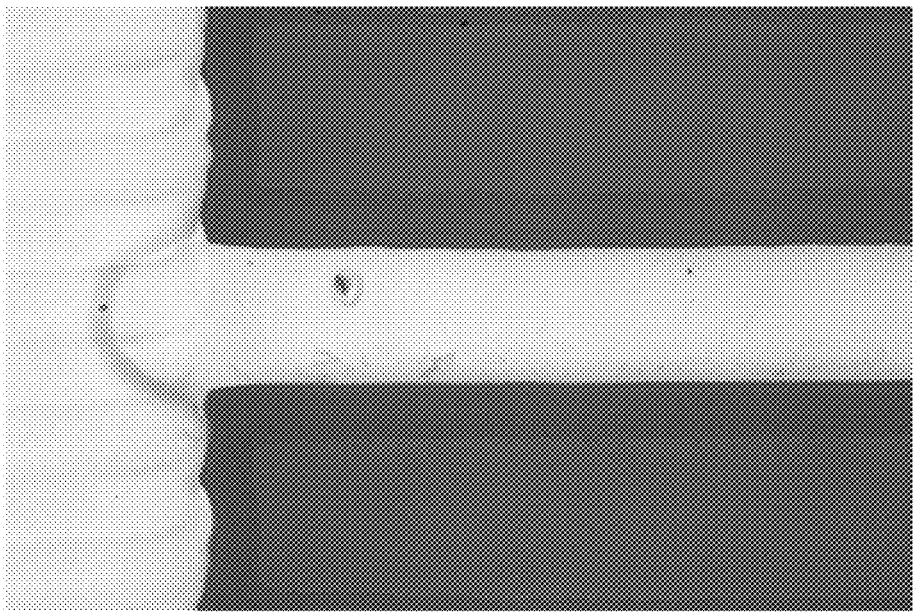
FIGS. 7A to 7C show images of durability evaluation after electroless plating with selectively cross-linked PVP-Pd composite material.
Figure 7B:
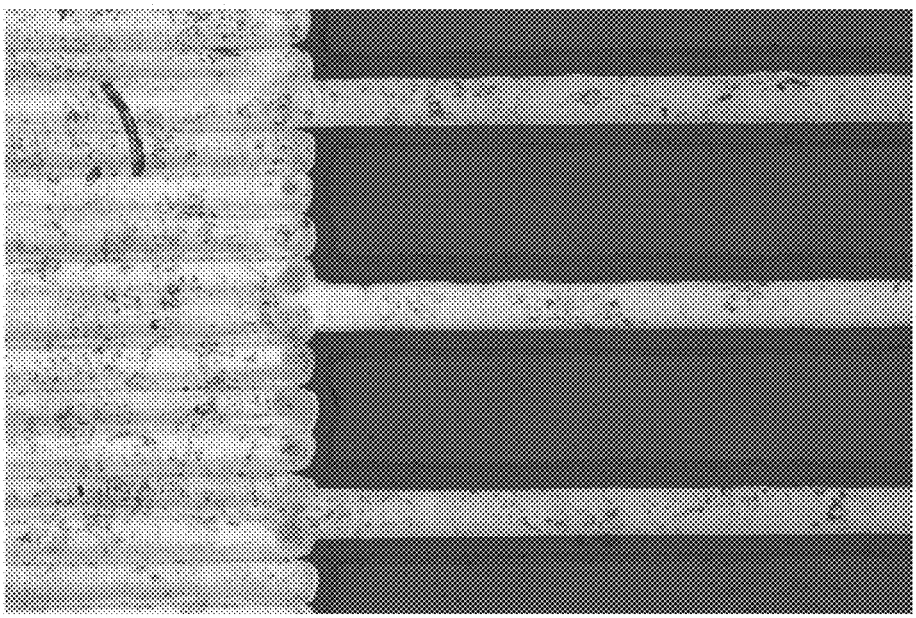
Figure 7C:
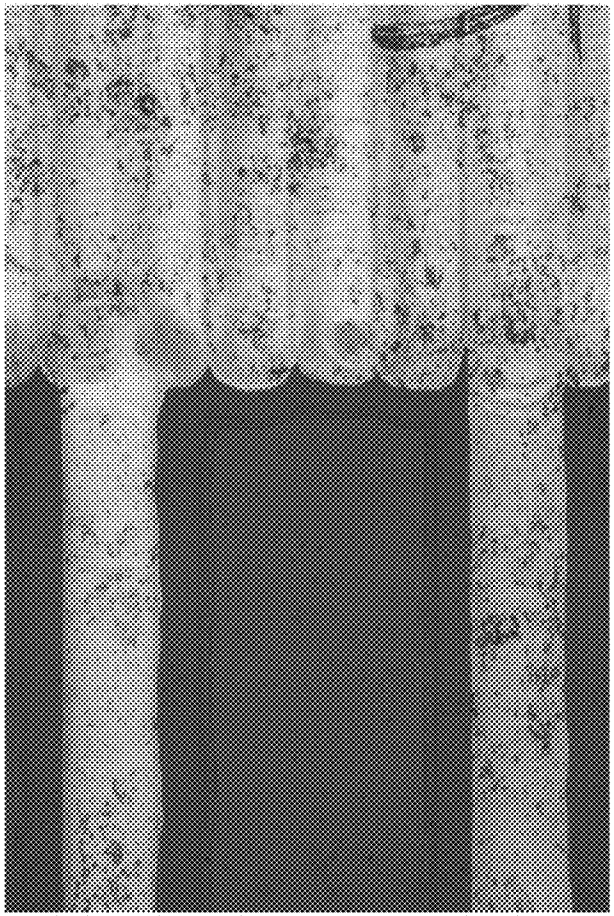

FIGS. 7A to 7C show images of durability evaluation after electroless plating with the selectively cross-linked PVP-Pd composite material. FIG. 7A shows a photograph of a copper electroless plated substrate before the 3M tape test peel test. FIG. 7B shows a photograph of the copper electroless plated substrate after 50 peel tests. FIG. 7C shows a photograph of the copper electroless plated substrate after 100 peel tests.

As shown in FIGS. 7A to 7C, the electroless plating pattern formed according to a still yet further embodiment of the present disclosure maintained excellent durability even after 50 and 100 peeling tests.

As such, the present disclosure may be used to manufacture metal wiring for electronic devices for the purpose of imparting conductivity to PCBs and IC chips. The present disclosure may be applied to all fields involving other metal wiring.

In addition, as described above, the polymer composite material is sintered by irradiation with the laser 30 to form the selective cross-linking layer 40. This makes the process of the present disclosure simple and fast and reduces photomask manufacturing costs. Thus, the process reduces costs and shortens the process time compared to conventional processes. In addition, the process offers excellent durability compared to conventional pattern formation processes while forming fine patterns.

As described above, the present disclosure has been described with reference to the specific details, limited embodiments and example, and accompanying drawings, but these are provided only to facilitate an overall understanding of the present disclosure, and the present disclosure is not limited to the above embodiments and example. Various modifications and variations can be made by those skilled in the art in the field to which the present disclosure pertains.

Accordingly, the spirit of the present disclosure should not be limited to the described embodiments and example. Not only the scope of the patent claims described later but also all things that are equivalent or equivalent to the scope of this patent claim fall within the scope of the present disclosure.

What is claimed is:

1. A method for forming an electroless plating electrode through selective cross-linking layer formation using a laser, the method comprising:

a polymer solution preparation step of preparing a polymer solution containing a water-soluble polymer with a PVP chain structure;

a polymer thin film layer formation step of forming a polymer thin film layer made of the polymer solution on a surface of a substrate through coating the substrate with the polymer solution;

a selective cross-linking layer formation step of forming a selective cross-linking layer by laser heat treatment of the polymer thin film layer, wherein the laser heat treatment is performed by irradiating the polymer thin film layer with a laser while moving the laser at a speed ranging from 1 mm/s to 5 mm/s and with a focal length ranging from 1 mm to 10 mm;

a residue removal step of removing a portion other than the portion for the selective cross-linking layer formed through the laser irradiation, wherein the residue removal step is performed by applying an ultrasound while immersing the substrate in distilled water or ethanol;

a catalyst activation step of activating a catalyst by performing a plasma treatment on the selective cross-linking layer, wherein the plasma treatment is performed using argon gas at a flow rate of 20 sccm, a power of 100 W, and a frequency of 100 kHz for 3 minutes; and an electroless plating step of forming an electroless plating layer on an upper part of the selective cross-linking layer by performing an electroless plating process on the selective cross-linking layer, which is formed on the substrate.

2. The method of claim 1, wherein the polymer solution includes a polymer-Pd composite material prepared by mixing a water-soluble polymer material with ethanol and a palladium compound.

3. The method of claim 2, wherein the palladium compound comprises one or more selected from the group consisting of palladium chloride ($PdCl_2$), tetraaminepalladium dinitrate ($Pd(NH_3)_4(NO_3)_2$), tetraamine palladium dichloride ($Pd(NH_3)_4Cl_2$), diamine palladium dichloride ($Pd(NH_3)_2Cl_2$), and palladium acid ($Pd(NO_3)_2 \cdot xH_2O$) or comprises a water-soluble palladium compound.

4. The method of claim 2, wherein the water-soluble polymer material comprises one or more selected from the group consisting of polyvinyl alcohol (PVA), polyvinyl pyrrolidone (PVP), and polyacrylic acid (PAA) or comprises derivatives thereof.

5. The method of claim 1, wherein, in the polymer thin film formation step, the polymer thin film layer is formed on the substrate with the water-soluble polymer material by any one method selected from the group consisting of spin coating, dip coating, and spray coating.

6. The method of claim 1, wherein the substrate comprises glass or a polymer material and is a transparent material.

7. The method of claim 1, wherein the laser comprises any one selected from the group consisting of a solid laser, a gas laser, and an optical fiber laser.

8. The method of claim 1, wherein, in the residue removal step, the substrate is immersed in the distilled water or ethanol for 1 to 2 minutes.

9. The method of claim 1, wherein, in the electroless plating step, the electroless plating layer is formed by electroless plating the upper part of the selective cross-linking layer with one or more selected from the group consisting of copper (Cu) and nickel (Ni).

* * * * *